US007249767B1

(12) United States Patent
Gorton

(10) Patent No.: US 7,249,767 B1
(45) Date of Patent: Jul. 31, 2007

(54) PORTABLE REBOUNDING BALL GAME

(76) Inventor: Nathaniel Craig Gorton, 22 Kennel Hill Dr., Beverly, MA (US) 01915

( * ) Notice: Subject to any disclaimer, the term of this patent is extended or adjusted under 35 U.S.C. 154(b) by 0 days.

(21) Appl. No.: 10/908,602

(22) Filed: May 18, 2005

Related U.S. Application Data

(60) Provisional application No. 60/572,591, filed on May 19, 2004.

(51) Int. Cl.
*A63B 63/04* (2006.01)

(52) U.S. Cl. ..... 273/396; 473/434

(58) Field of Classification Search ..... 273/395, 273/396; 473/434, 435
See application file for complete search history.

(56) References Cited

U.S. PATENT DOCUMENTS

| | | | | |
|---|---|---|---|---|
| 2,482,234 | A * | 9/1949 | Barker | 273/395 |
| 3,088,735 | A * | 5/1963 | Clark | 473/434 |
| 3,697,068 | A * | 10/1972 | McDougall | 473/434 |
| 4,134,585 | A * | 1/1979 | Semon | 473/434 |
| 4,373,720 | A * | 2/1983 | Lombardi et al. | 473/434 |
| 4,421,318 | A | 12/1983 | Sverdlik et al. | 273/395 |
| 5,354,051 | A * | 10/1994 | Fehrenbach et al. | 473/434 |
| 5,531,449 | A | 7/1996 | Denton | 273/348 |
| 5,935,024 | A * | 8/1999 | Lao | 473/434 |
| 6,213,900 | B1 * | 4/2001 | Steyn et al. | 473/434 |
| 6,585,610 | B2 | 7/2003 | Sompolinsky | 473/435 |
| 2005/0049088 | A1 * | 3/2005 | Chang et al. | 473/434 |
| 2005/0170916 | A1 * | 8/2005 | Morrison | 473/434 |

* cited by examiner

*Primary Examiner*—Mark S. Graham
(74) *Attorney, Agent, or Firm*—George A. Herbster

(57) ABSTRACT

A portable ball rebound game includes a ball for being thrown at a rebound panel. Generally the rebounding surface of the rebound panel defines a compound curve to minimize the predictability of any rebound trajectory. Preferably the rebounding surface models the surface of a rock.

7 Claims, 8 Drawing Sheets

PORTABLE REBOUNDING BALL GAME

FIELD OF THE INVENTION

This invention generally relates to games and more particularly to a game in which a ball bounces off a rebounding device.

DESCRIPTION OF RELATED ART

Squash, racquet ball and handball are examples of games in which one player, as a "thrower," throws a ball at a rebound device to be caught by another player as a "catcher" on the rebound. Characteristically these games are played with rebound devices in the form of one or more walls. Stoopball is an example of a game in which the rebound device is a set of stairs. Attempts have been made to adapt the game of stoopball by providing a portable rebound device.

For example, U.S. Pat. No. 4,421,318 to Sverdlik et al. discloses an adjustable rebound device in which two spaced triangular support frames carry a part-cylindrical rebound panel with a smooth rebound surface. The rebound panel is curved about a single horizontal or vertical axis and can be used with either a convex or concave surface facing the thrower. The frames adjust to vary the inclination of the rebound panel.

U.S. Pat. No. 5,531,449 to Denton discloses a portable stoopball striker with an A-shaped framework having a rearwardly tilted front panel for being supported on a horizontal playing field. The front panel has a striking device divided into a flat sloped upper surface, a horizontal edge and a curved lower surface. A thrower directs a ball against the striking device to rebound at different angles and speed into a playing field.

As another example, U.S. Pat. No. 6,585,610 to Sompolinsky discloses a variation of a portable stoopball playing device in which a front, or playing panel, includes a plurality of sheer surfaces and protrusions on its playing surface to produce random and unpredictable ball rebounds. The playing panel also includes vertical and horizontal curvature to increase the rebounding angle of a thrown ball to allow an increasing number of players to participate in a single game.

The Sompolinsky patent has an objective of producing "random and unpredictable rebounding", while the Sverdlik et al. patent provides "a wide range of rebound angles." Each reference discloses curves around a horizontal axis or a vertical axis, but not both. Consequently, the thrower may still control and direct the rebounding angle of the thrown ball. To that extent the stoopball devices shown by Sompolinsky and Denton and the part-cylindrical panel of Sverdlik et al. still provide somewhat predictable rebound angles. Consequently with practice a thrower can direct a ball to produce a specific location to a predictable rebound. Experienced players therefore can gain an advantage over inexperienced players. Further, if the game becomes predictable, players can lose interest.

For many years people have played another rebound game on one beach. This game is played using an unusually shaped rock. Players alternate turns throwing a ball against the rock and catching the ball upon its rebound from the rock. The rock surface roughly forms an inclined plane; however, variations in its surface make the rebound trajectory of the ball unpredictable. This game uses an immobile rock as a rebounding device, thus limiting one's ability to play the game even with other rocks because other rocks may not have the general size and shape that are conducive to playing the game. It would be desirable to create a portable version of the game, to be played on a variety of playing surfaces.

Although rebound games such as shown by Sverdlik et al., Denton and Sompolinsky are known in the art, they all incorporate predictable rebound surfaces (i.e. planar, cylindrical, etc.). Such approaches do not provide a rebound surface that causes unpredictable rebound trajectories which is crucial to the enjoyment of the original game. What is needed is a game that is adapted for mass manufacture and that provides the unpredictability of a rock.

SUMMARY

Therefore it is an object of this invention to provide a rebound game with new characteristics.

Another object of this invention is to provide a rebound game that provides the unpredictability of and the look of a rock.

Still another object of this invention is to provide a rebound game in which the rebound direction is entirely arbitrary and independent of the expertise of the individual throwing the ball.

Yet another object of this invention is to provide a rebound game that includes portable components.

Still yet another object of this invention is to provide a rebound game that is easy to use, yet adapted for a variety of game rules.

Yet still another object of this invention is to provide a rebound game that is economical to manufacture.

In accordance with this invention a rebound game includes a rebound panel against which a ball can be thrown and a supporting structure. The rebound panel has a compound surface that curves about two non-parallel axes. The support structure supports the rebound panel in a playing position whereby the rebound trajectory of the ball is unpredictable.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
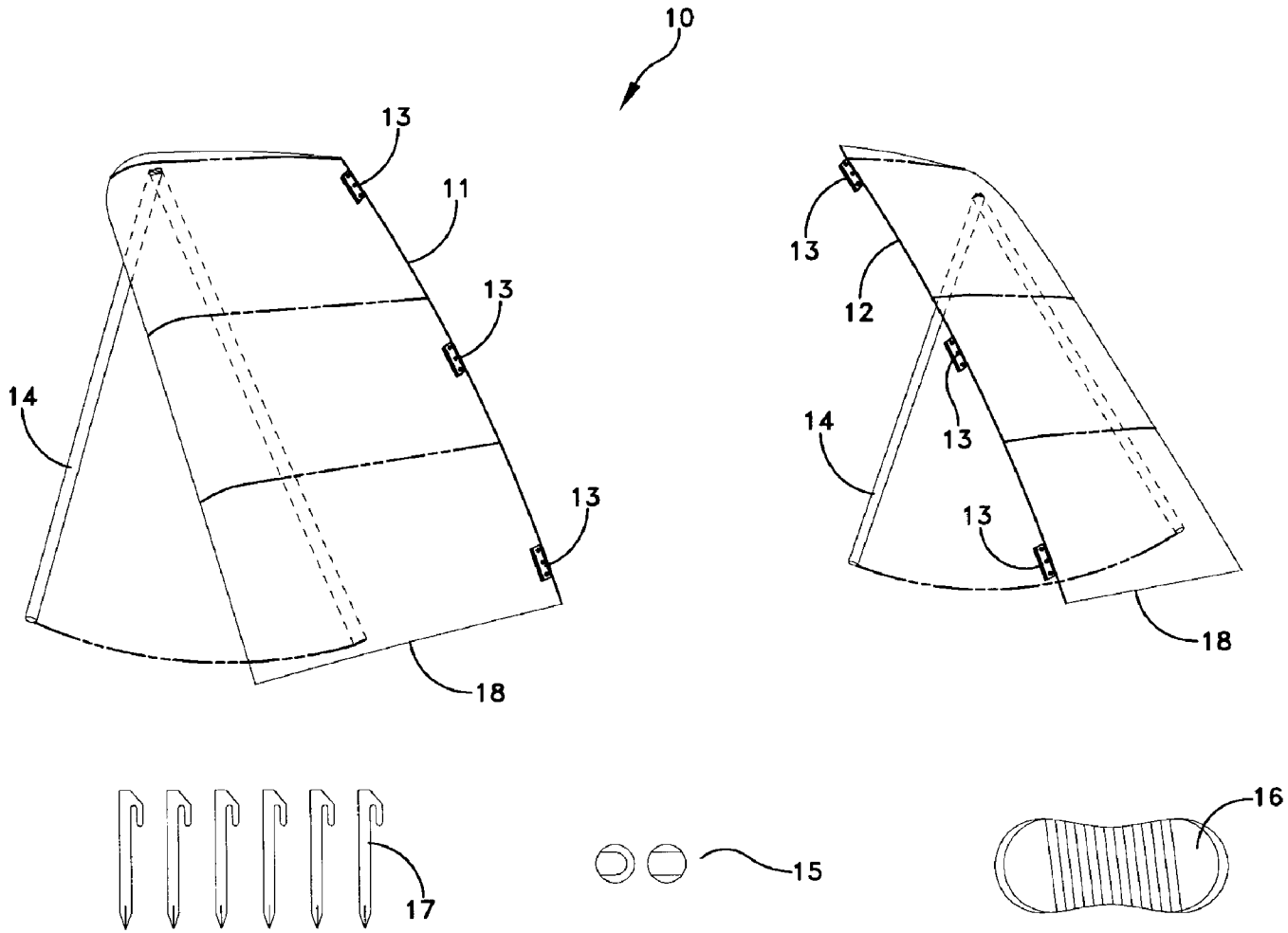
FIG. 1 depicts the components in a rebound game that embodies this invention.

FIG. 1 depicts one embodiment of a set 10 of game components for implementing this invention. The set 10 includes first and second rebound panel sections 11 and 12 with irregularly-shaped playing surfaces. The panel sections 11 and 12 connect together as by slip hinges 13 or equivalent structures. Legs connect to each of the panel sections 11 and 12 to position the panel sections 11 and 12 on the ground. Separation of the legs 14 from the bases of the panel sections 11 and 12 also control the slope of the panel with respect to the ground. Implementing this invention with multiple panel sections facilitates manufacture by various known means that can produce a lightweight rigid structure. The construction of such supports is well known in the art.

The set 10 also includes at least one ball, such as a tennis ball. Two balls 15 are shown in FIG. 1. A boundary line package 16 contains tape, rope or other material for laying out a field with stakes 17 being provided for affixing the boundary material to the ground. If the panel sections 11 and 12 are formed with sides, closing the panel sections can facilitate transportation and provide storage for the various other components of the game.

Figure 2:
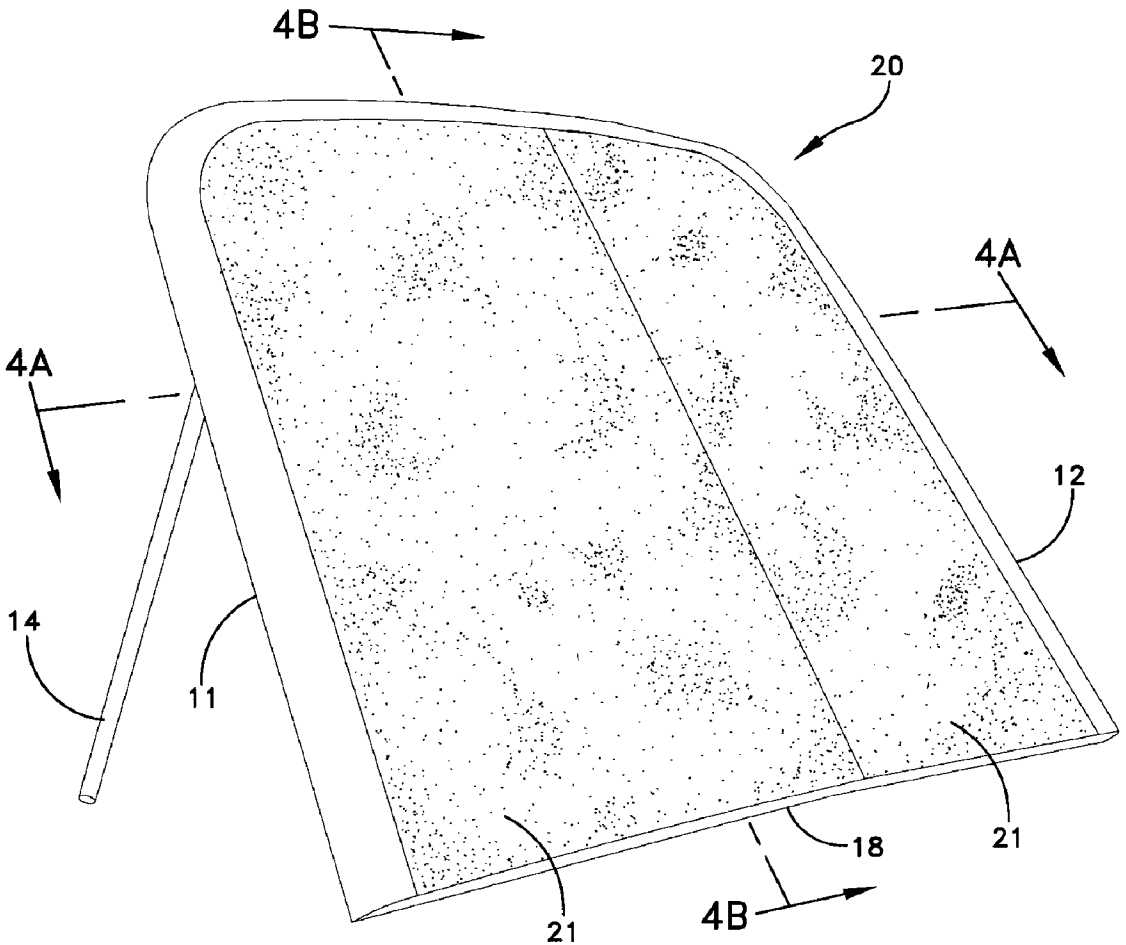
FIG. 2 is a view of a rebound device that presents a convex rebound surface to a thrower.

When the panel sections 11 and 12 are assembled, the resulting assembly produces a rebound panel 20 as shown in FIG. 2 that has an irregular rebounding surface 21. In one specific embodiment, the rebounding surface may present a generally convex rebounding surface to allow a player to choose approximately which direction the ball will rebound subject to the inconsistencies of the rock-like surface 21. The legs 14 can also be adjusted to change the inclination of the rebound panel 20. By altering the slope of the rebound panel 20 and the rebounding surface 21, it is possible to optimize the vertical component of the rebound while still preserving the non-predictability of the rebound trajectory for players of different ability and experience.

FIG. 2 depicts a rebound panel 20 with a rebounding surface 21 having one specific "rock-like" texture. As described later, other surface textures may be substituted that may resemble different types of rock.

Figure 4B:
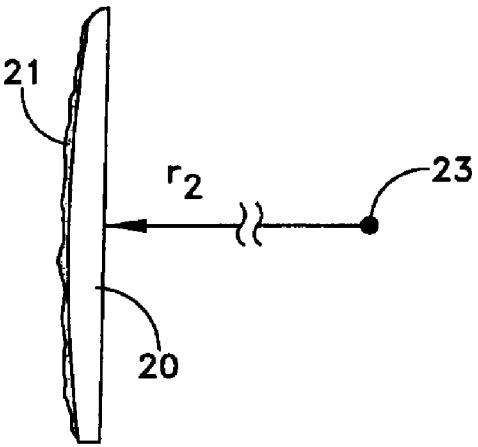
FIG. 4B is a cross sectional view taken along lines 4B-4B of FIG. 2.
Figure 4A:
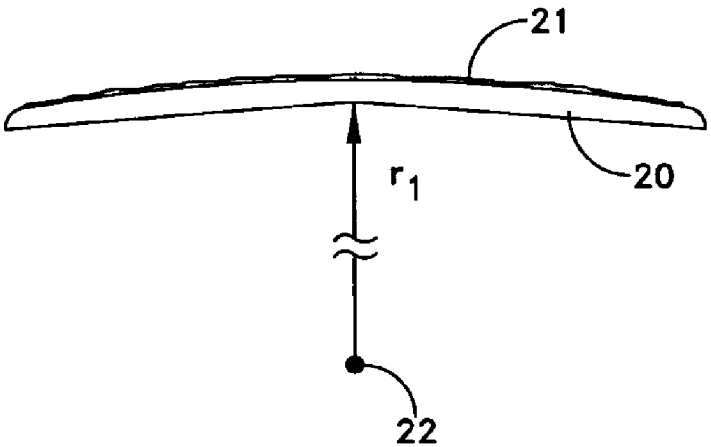
FIG. 4A is a cross sectional view of a portion of the rebounding panel shown in FIG. 2 taken along lines 4A-4A.

FIGS. 4A and 4B depict a portion of the rebound panel 20 with a double-curved, convex rebound surface 21, such as shown in FIG. 2. As shown in FIG. 4A, which shows the panel 20 is an exaggerated scale, the panel 20 curves around a vertical axis 22 on the back side of the rebound panel 20 with a radius $r_1$ to form a panel with a convex configuration This curve may have a constant radius wherein $r_1=K_i$ or multiple radii to produce a varying degree of curvature in a horizontal plane, $r_1=f(\alpha_1)$ where "$\alpha_1$" is an angle from a reference, such a reference extending from the axis 22 through the center of the panel 20. In FIG. 4B the panel 20 also curves around an axis 23 on the back side of the rebound panel 20 with a radius $r_2$. Like $r_1$, $r_2$ may be constant, $r_2=K_2$, or may be variable; i.e., $r_2=f(\alpha_2)$ where "$\alpha_2$" is an angle from a reference, such a reference extending from the axis 23 through the center of the panel 20. The result is a rebounding surface characterized as a compound curved surface defined by curvatures about two non-parallel axes.

Figure 5B:
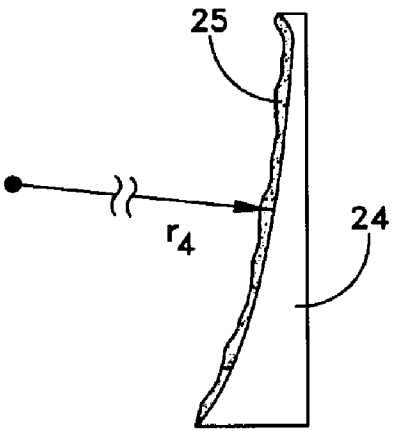
FIGS. 5A and 5B are cross sectional views corresponding to those shown in FIGS. 4A and 4B, but of a portion of a rebound panel that presents a concave rebound surface to a thrower.
Figure 5A:
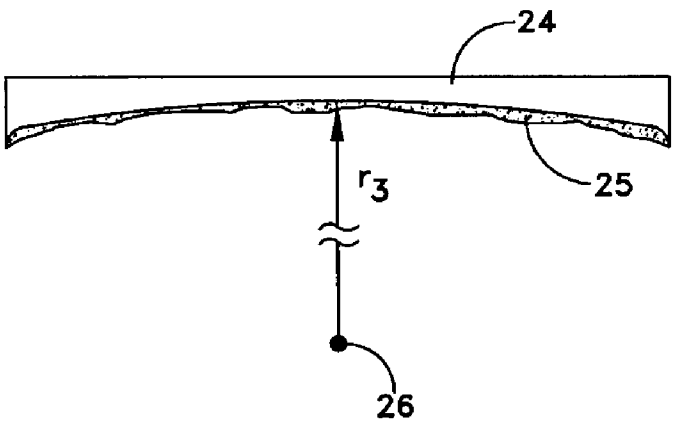

FIGS. 5A and 5B depict a portion of an alternative rebound panel 24 with a concave configuration in which a rebound surface 25 lies on a concave compound curved surface. In this embodiment, the radii of curvature for the rebound panel 24 a radius of curvature, $r_3$, extends from a vertical axis 26 while a radius of curvature, $r_4$, extends from a horizontal axis 27. As previously described, each of these radii can be constant or variable.

Figure 6C:
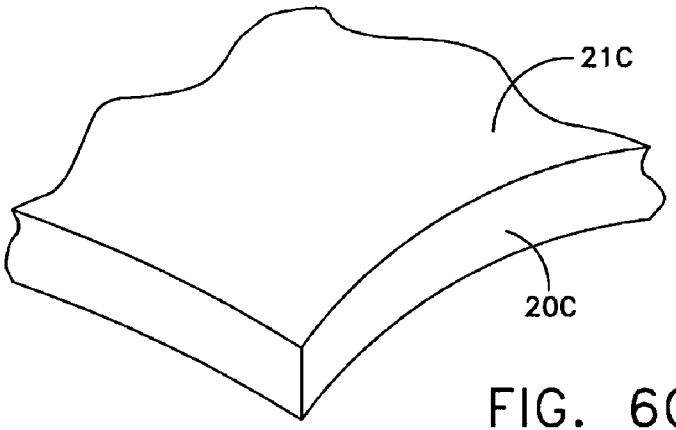
FIGS. 6B and 6C are enlarged perspective views that illustrate different rebound surface treatments.
Figure 6A:
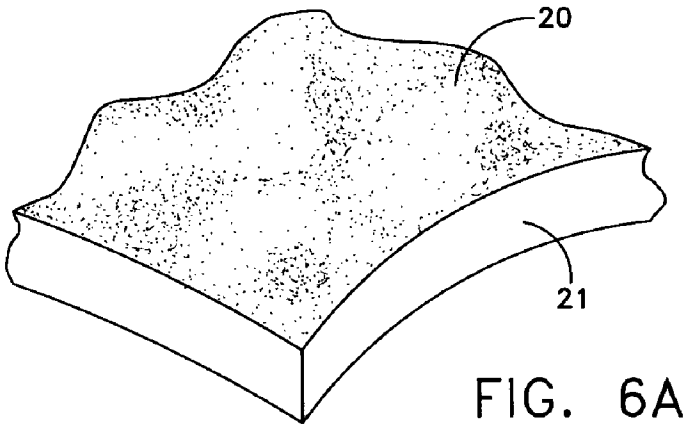
FIG. 6A is an enlarged perspective view of a portion of the rebound surface shown in FIG. 1.

Different embodiments of this invention can also incorporate different rebound surface structures. FIG. 6A is an enlarged view of the rebound surface 21 shown in FIGS. 2, 4A and 4B. Referring to FIG. 6A, the textured rebound surface 21 mimics or models the appearance and rebound characteristics of a real rock. That is, the rebound surface has a random topography of rock-like protrusions and depressions whereby the rebounding surface 21 provides complete unpredictability of rebound trajectory.

Figure 6B:
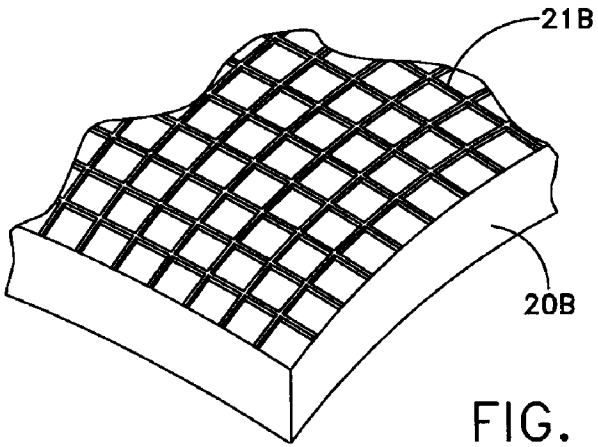

FIG. 6B depicts a portion of an alternative surface with a non-skid or textured rebound surface 21A that provides a degree of unpredictability of rebound trajectory. FIG. 6C depicts a smooth surface 21B wherein the degree of unpredictability of rebound trajectory is primarily a function of the shape of the compound surface. As will be apparent, however, as the degree of unpredictability of rebound trajectory decreases, the game becomes easier to master and therefore may be better suited for younger children.

Figure 7:
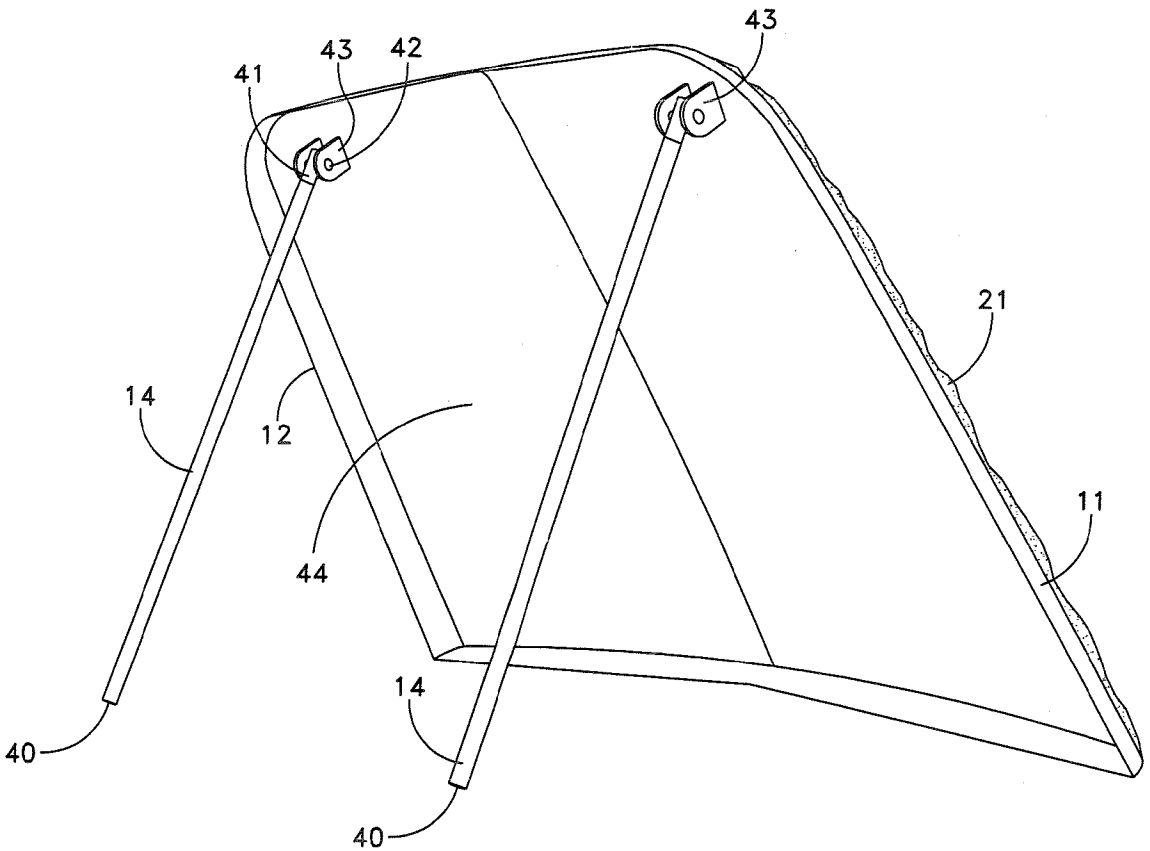
FIG. 7 is a view that illustrates the mechanism for providing a rebound surface with a variable inclination.

FIG. 7 depicts a portion of a panel 11 with an attached leg 14. As will be apparent, the leg 14 includes a base 40 for resting on the ground or like support surface. The other end of the leg 14 carries a hinge 41 that attaches to a hinge pin 42 held by a bracket 43 on a side 44 of the rebound panel 11 that is opposite the rebounding surface 21. Although the leg 14 is fixed in length, it has sufficient flexibility to establish a desired degree of inclination on most surfaces. If greater flexibility is required, any of a number of axially-extendible legs with internal locking mechanisms could be substituted. Controlling the degree of inclination enables the players to further adjust the degree of difficulty by effecting a player's required reaction time. As the inclination increases, the loft of a rebounding ball will increase, so the time it takes for a rebounding ball to reach a player also increases.

Referring again to FIG. 1, each ball 15 in one embodiment comprises a specially marked tennis ball. Other balls subject to rebound can be used to enhance or degrade the amount to rebound making it more or less difficult to catch and throw the ball.

Figure 3:
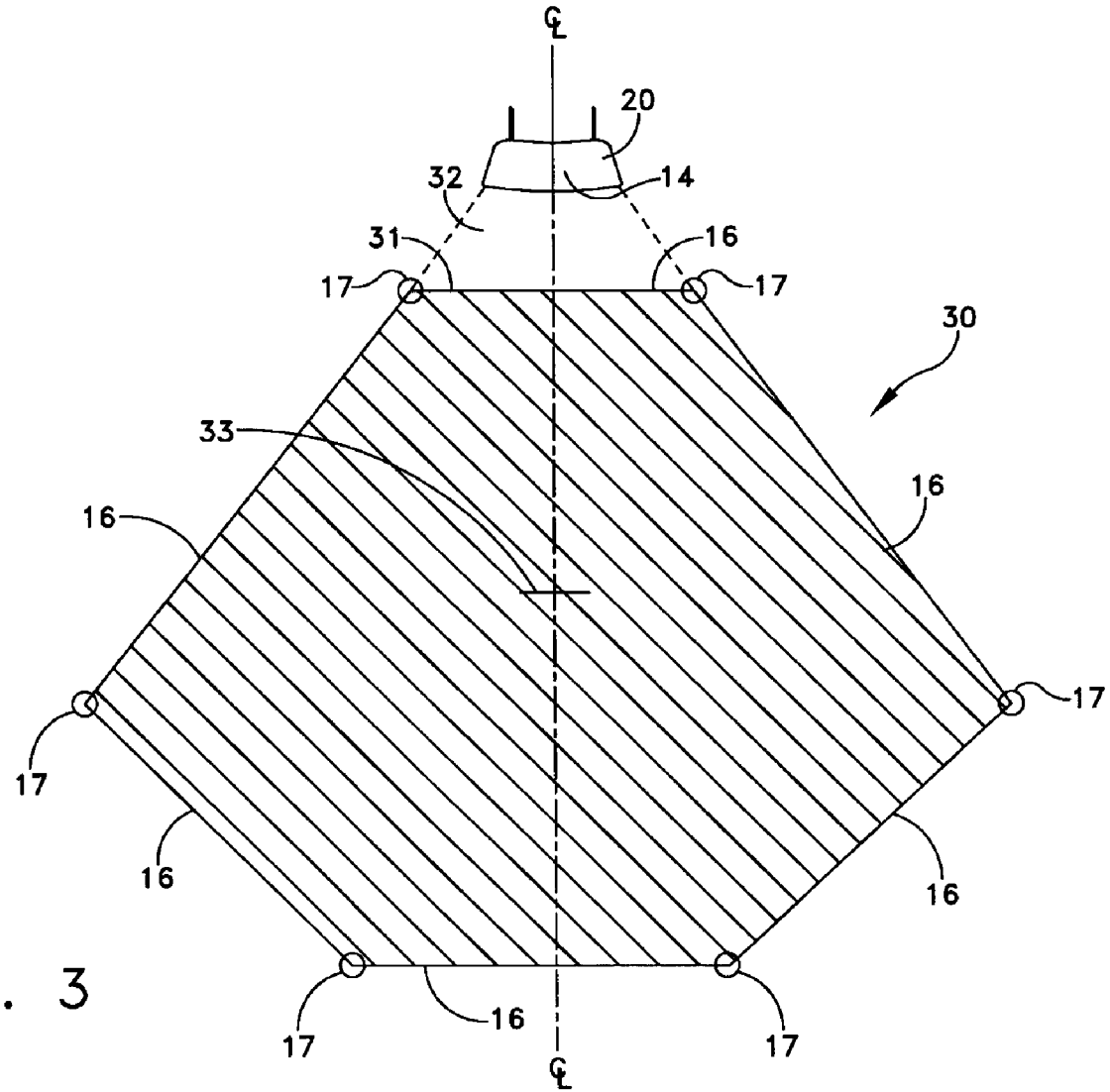
FIG. 3 depicts an environment for playing the game.

The boundary line package 16 and stake 17 can be used to define a field of play 30, such as shown in FIG. 3 that has a hexagonal form found by the bounded material 16 with a stake 17 at each corner. A first edge 31 of the field of play 30 may be spaced from the rebounding device 20 so that any ball hitting the intermediate area, called an "out of bounds area" 32, would be a dead ball. FIG. 3 depicts a service line 33 from which a thrower directs the ball at the rebounding device 20 or which sets a forward limit of a throwing area. Other methods may be used to delimit the boundary area depending upon the playing surface. Other boundary configurations and dimensions are also possible.

In one embodiment, the rules of play dictate that an individual thrower, in the case of team play, a designated thrower, begins a rally or serves, by throwing the ball from behind the service line 33. Upon rebound, a member of an opposing team or an opposing player must either catch the ball or allow it to drop. If the ball is successfully caught before contacting the ground the rally continue when the catcher throws the ball from the position of the catch, and the players' roles reverse. If the ball lands outside the playing area, the thrower loses the point and the serve passes to the opposing team or an opposing player. Similarly, if the ball lands within the playing area the thrower wins the point and serves again until a winning score is achieved.

As will be apparent, other scoring systems may be used. For example, points could be awarded to the catcher whenever a ball is caught. As another variation, if three players are involved, each thrower might have a certain number of throwing opportunities. Then the thrower might receive a point if the ball drops to the ground without being caught. When anyone catches the ball, that person could be awarded a point. The establishment of winning scores is also arbitrary. Other variations on the rules may allow for different numbers of players.

Figure 8:
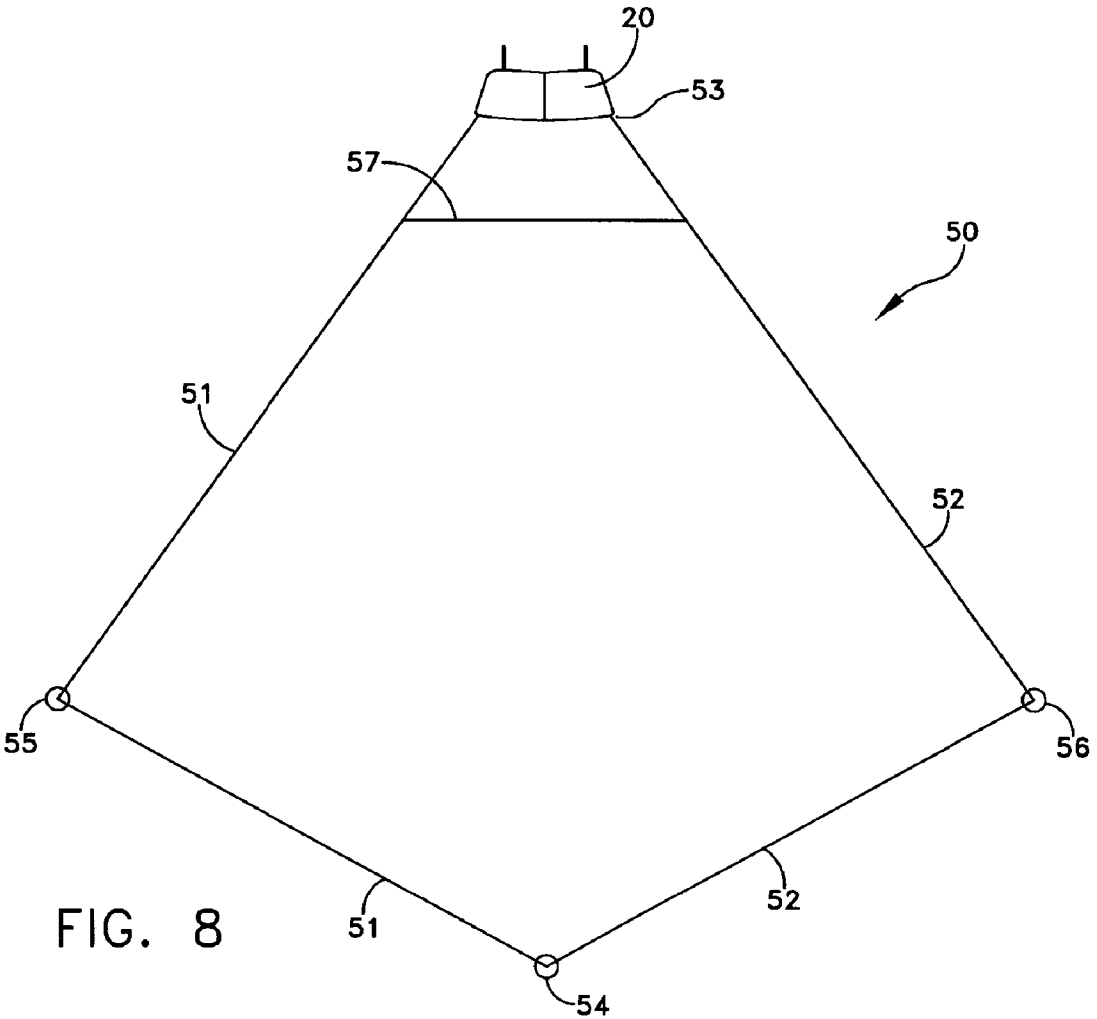
FIG. 8 depicts an alternative environment for playing the game.

FIG. 3 depicts a six-sided field of play 30. FIG. 8 depicts an alternative five-sided playing field 50 that includes a rebound panel 20 that can be easily established using two tapes 51 and 52 of equal length contained in a package like the boundary line package 16 in FIG. 1. After deciding the orientation of the field of play 50, the rebound panel is located facing the field of play at a head position 53. Then a stake is placed at a position 54 at the rear of the field of play 50 centered on the rebound panel. The tapes 51 and 52 are stretched from stakes at positions 55 and 56, respectively to the stake at position 54. Next each of the tapes 51 and 52 is stretched at right angles in opposite directions to the line between the center of the rebound panel 20 and the position 54. Stakes then fix those tapes at positions 55 and 56 to complete the field of play. A short serve line 57 completes the field of play by being attached a short distance from the rebound panel 20 to the tapes 51 and 52 to be at right angles to the line from the center of the rebound panel 20 to the position 54.

As will now be apparent, the formation of the irregular rebound surface 21 minimizes the predictability of any rebound trajectory. If the thrower must move to different places within the field of play 30 of FIG. 3 or the field of play 50 in FIG. 8, the potential for controlling the rebound trajectory is even further reduced. Consequently individuals of different experience levels can play the game with equal chances of winning.

Many variations can be made to the components and layouts of this game. As will be apparent, any number of different rebound devices 20 can be formed with different configurations. The rebound devices may be formed of multiple sections or as integral units. It is possible with a multiple section implementation to cant one section with respect to another through the hinge, or a like, axis. Although tennis balls are the preferred embodiment, balls with other characteristics could be used. FIGS. 6A, 6B and 6C depict different surfaces as integral surfaces with their respective rebound panels so the degree of unpredictability lies in a fixed range. Others may be formed of a plurality of small facets. It is also possible to delineate different areas on the rebounding surface by texture, color or both. It is also possible to produce a panel base and a separate surface attachment, each with a different surface treatment thereby to allow a single basic structure to be used by persons having a wide range of skills.

Therefore it is the intent of the appended claims to cover all such variations and modifications as come within the true spirit scope of this invention.

What is claimed is:

1. A rebound game comprising rebound panel means for returning a ball thrown against said rebound panel means, said rebound panel means comprising:

A) a rebound panel curved about two non-parallel axes thereby defining a compound convex curved rebound surface, said rebound surface additionally having an irregular topography of protrusions and depressions whereby the combination of the compound convex curved rebound surface and the irregular topography produces unpredictable rebound trajectories that simulate the rebound trajectories of a rock, and B) means for supporting said rebound panel.

2. A rebound panel for use in a rebound game as recited in claim 1 wherein said rebound panel has one edge that rests on a support surface and said supporting means comprises leg means for engaging the support surface and hinge means for attaching said legs to said rebound panel.

3. A rebound panel for use in a rebound game as recited in claim 2 wherein said rebound panel comprises a plurality of panel sections with means for connecting said panel sections to form said rebound panel.

4. A rebound panel for use in a rebound game as recited in claim 3 wherein at least two of said panel sections include leg and hinge means.

5. A rebound panel for use in a rebound game as recited in claim 1 wherein said rebound panel comprises a plurality of panel sections with means for connecting said panel sections to form said rebound panel.

6. A rebound panel for use in a rebound game as recited in claim 2 wherein said support means positions said rebound panel with an inclination.

7. A rebound panel for use in a rebound game as recited in claim 6 wherein said rebound panel has one edge that rests on a support surface and said supporting means comprises adjustable leg means for engaging the support surface whereby the inclination of said rebound panel can be varied.

* * * * *